US008517195B2

(12) United States Patent
Glover

(10) Patent No.: US 8,517,195 B2
(45) Date of Patent: Aug. 27, 2013

(54) PLASTICS CONTAINER

(75) Inventor: Andrew Glover, Buckinghamshire (GB)

(73) Assignee: Nampak Plastics Europe Limited, Buckinghamshire (GB)

( * ) Notice: Subject to any disclaimer, the term of this patent is extended or adjusted under 35 U.S.C. 154(b) by 151 days.

(21) Appl. No.: 12/993,769

(22) PCT Filed: Aug. 25, 2010

(86) PCT No.: PCT/GB2010/051412
§ 371 (c)(1),
(2), (4) Date: Nov. 19, 2010

(87) PCT Pub. No.: WO2011/051694
PCT Pub. Date: May 5, 2011

(65) Prior Publication Data

US 2011/0215104 A1 Sep. 8, 2011

(30) Foreign Application Priority Data

Oct. 26, 2009 (GB) ..... 0918744.4
Jul. 1, 2010 (GB) ..... 1011029.4

(51) Int. Cl.
*B65D 90/12* (2006.01)
*B29C 49/28* (2006.01)

(52) U.S. Cl.
USPC ..... 215/376; 220/675; 220/771; 425/525; 264/523

(58) Field of Classification Search
USPC ..... 220/675, 623, 610, 770, 660, 600; 215/376, 373, 372, 370, 398; 264/523; D9/520, 531, 536; 425/525, 522
IPC ..... B65D 90/12, 23/10, 25/28, 25/30; B29C 49/28, 49/00
See application file for complete search history.

(56) References Cited

U.S. PATENT DOCUMENTS

| | | | | | |
|---|---|---|---|---|---|
| 2,641,374 | A | * | 6/1953 | Der Yuen | 215/10 |
| 3,892,829 | A | * | 7/1975 | Uhlig | 264/530 |
| 4,016,995 | A | | 4/1977 | Frazer | |
| 5,112,561 | A | * | 5/1992 | Dickinson | 264/531 |
| D391,854 | S | | 3/1998 | Ankney et al. | |
| 5,927,533 | A | * | 7/1999 | Payne et al. | 215/384 |
| D417,621 | S | * | 12/1999 | Hofmeister et al. | D9/528 |
| 6,059,153 | A | | 5/2000 | Olson et al. | |

(Continued)

FOREIGN PATENT DOCUMENTS

| | | |
|---|---|---|
| GB | 1 042 998 | 9/1966 |
| GB | 2 447 334 | 9/2008 |

(Continued)

*Primary Examiner* — Robert J Hicks
(74) *Attorney, Agent, or Firm* — Nixon & Vanderhye P.C.

(57) ABSTRACT

A method of producing a plastics milk container involves blow molding a parison in a mold tool configured to produce a container having a body with a handle eye which defines a central axis extending in a first direction through the body, and a footprint with a longitudinal axis extending in a direction perpendicular to the first direction. The footprint defines four major sides and four major corner regions, each corner region arranged between a respective two of the major sides. The longitudinal axis extends through a center point of the footprint, and the maximum radial extent of the footprint from the center point is greatest where the footprint intersects the longitudinal axis, corresponding to the location of two of the corner regions, so that the extent of parison stretch away from the mold tool split line is less than the extent of parison stretch along the split line.

29 Claims, 11 Drawing Sheets

(56) References Cited

U.S. PATENT DOCUMENTS

| | | | | |
|---|---|---|---|---|
| 6,068,161 | A | 5/2000 | Soehnlen et al. | |
| 6,527,133 | B1 | 3/2003 | McCollum et al. | |
| 2003/0155324 | A1* | 8/2003 | McCollum et al. | 215/382 |
| 2006/0070974 | A1* | 4/2006 | Roubal et al. | 215/373 |
| 2006/0260971 | A1 | 11/2006 | Rivera et al. | |
| 2006/0261030 | A1* | 11/2006 | Manderfield, Jr. | 215/376 |
| 2007/0221606 | A1 | 9/2007 | Eiten et al. | |
| 2007/0235905 | A1* | 10/2007 | Trude et al. | 264/523 |
| 2008/0083696 | A1* | 4/2008 | Nievierowski et al. | 215/384 |
| 2008/0217200 | A1* | 9/2008 | Eiten et al. | 206/504 |

FOREIGN PATENT DOCUMENTS

| | | |
|---|---|---|
| JP | 6-247448 | 9/1994 |
| JP | 8-318921 | 12/1996 |
| JP | 8-324532 | 12/1996 |
| WO | WO 99/22994 | 5/1999 |

* cited by examiner

PLASTICS CONTAINER

This application is the U.S. national phase of International Application No. PCT/GB2010/051412 filed 25 Aug. 2010 which designated the U.S. and claims priority to Great Britain Patent Application No. 0918744.4 filed 26 Oct. 2009 and Great Britain Patent Application No. 1011029.4 filed 1 Jul. 2010, the entire contents of each of which are hereby incorporated by reference.

The present invention relates to a plastics container, more particularly, but not exclusively, to a blow moulded plastics container of the kind commonly used for transporting or storing milk.

It is known to package milk in lightweight plastics containers for retail through supermarkets and the like. There is a desire to make such plastics containers as light as possible, whilst ensuring that they remain fit for purpose in delivering the product in good condition for consumers.

In an attempt to define "fit for purpose", the UK packaging industry works to an empirical 60 N topload force test. If a lightweight plastics container is able to withstand a 60 N topload force applied at a rate of 4 mm per second over a set distance, experience shows that it will survive the milk filling and distribution system and retail successfully to the consumer.

At present, for each container of the regular capacity sizes of milk container (e.g. 1 pint, 2 pint, 4 pint, 6 pint or 1 liter, 2 liter etc), there is a weight "ceiling" which means that it is difficult to manufacture a lighter container that is still fit for purpose (e.g. suitable to pass the empirical 60 N topload force test).

It is an object of the invention to reducing the weight of standard capacity plastics milk containers without compromising structural integrity, i.e. so that the containers remain fit for purpose.

According to a first aspect of the invention, there is provided a plastics container, preferably of blow-moulded construction, for storing liquid (e.g. milk), wherein the container is of the kind having a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein the maximum radial extent of the footprint from the centre point is greatest where the footprint intersects the longitudinal axis, corresponding to the location of two of said corner regions.

According to another aspect of the invention, there is provided a plastics container, preferably of blow-moulded construction, for storing liquid (e.g. milk), the container having a body with a footprint having a transverse axis extending in a first direction and a longitudinal axis extending in a second direction which is perpendicular to said first direction, wherein the footprint defines four major sides and four major corner regions, with each corner region arranged between a respective two of said major sides, and the footprint has a centre point through which the longitudinal and transverse axes extend, wherein the maximum radial extent of the footprint from the centre point is greatest where the footprint intersects the longitudinal axis, corresponding to the location of two of said corner regions.

A known plastics container has a substantially rectangular footprint, with two corner regions on each side of a notional centre line, wherein all four of the corner regions are equidistant from the centre of the footprint. An example of a mould cavity for blow moulding such a container is shown in FIG. 25, wherein the container is formed by blow moulding a parison in the mould, the mould having two parts which separate along the centre line of the container when ejecting the container from the mould.

It is often the case that when a parison is blown into a rectangular cavity of the kind shown in FIG. 25 (in which the mould split occurs through opposing parallel faces of the container), aggressive stretching/thinning of the parison wall thickness occurs, particularly in the corner regions (i.e. at the furthest distance from the centre point). Of course, this problem is likely to become particularly acute when attempting to reduce the overall plastic content of the container.

The present inventors have appreciated that each corner region represents a potential weak point in the body as a whole. Accordingly, the present inventors have proposed a container with a novel footprint as set forth above in accordance with the above aspects of the invention, in which the longitudinal axis of the footprint is, in effect, arranged 'corner to corner' through the centre point, i.e. 45 degrees to that shown in FIG. 25.

Furthermore, the footprint is configured so that the maximum radial extent of the footprint from the centre point is greatest where the footprint intersects the longitudinal axis, corresponding to the location of two corner regions of the footprint, i.e. so that the radial extent from the centre point at the other two corner regions is less than the maximum radial extent of the footprint.

This configuration has been found to exhibit less tendency for localised thinning of the wall thickness in critical areas if formed by blow moulding. Tests have shown that the overall weight of the plastics container may be reduced by adopting this footprint, whilst maintaining storage capacity and the structural integrity necessary to meet the 60 N topload force test requirement.

The orientation of the longitudinal axis corresponds to the orientation of the mould tool split line in a mould tool for blow moulding the container. It has been found that the stretching/thinning effect on the parison in a mould configured to produce a bottle having a footprint in accordance with the above aspects of the invention is likely to be less extreme than with conventional mould tools of the kind shown in FIG. 25, resulting in more even distribution of plastic within the wall thickness.

More particularly, the footprint configuration of the invention has the advantageous effect of reducing parison stretch away from the mould tool part line (the position of which corresponds to the longitudinal axis of the footprint), which reduces the tendency for localised thinning in the corners, thereby providing a weight saving opportunity.

Any corner region may be rounded or truncated (e.g. so as to produce a footprint having four additional sides, one at each corner region), rather than a sharp rectangular corner region.

In preferred embodiments, the degree of curvature or truncation at the corner regions away from the longitudinal axis differs from the degree of curvature or truncation at the corner regions along the longitudinal axis, e.g. so as to be more curved/rounded (than angular) or truncated away from longitudinal axis.

Preferably, the footprint is of generally rectangular configuration, wherein the four major sides comprise two pairs of at least generally parallel sides, with the first of said two pairs arranged at least generally perpendicular to the second of said two pairs, and wherein the sides in said first pair are longer than the sides in said second pair.

In preferred embodiments, a first two of said corner regions are arranged at least generally in opposition along the longitudinal axis, and wherein the second two of said corner regions are asymmetrically arranged about said longitudinal axis.

Preferably, the footprint has a transverse axis perpendicular to the longitudinal axis and arranged halfway along the longitudinal axis, and wherein the second two of said corner regions are off set from said transverse axis.

Preferably, the footprint of the body, e.g. the overall space envelope of the main body of the container when viewed from beneath, is rotationally symmetrical about said longitudinal axis.

In a preferred embodiment, the body has an integral handle which is arranged to extend in a direction which is substantially 45 degrees to the four major sides of the footprint.

In preferred embodiments, the body defines a relief region on either side of the handle eye, wherein the size of the relief region on one side of the longitudinal axis is greater than the relief region on the other side of the longitudinal axis.

Preferably, the integral handle is intended to be generally upright during storage.

Preferably, the handle eye is taller than it is wide.

The body may define a chamber for storing liquid, with the chamber extending into and/or through the integral handle.

Preferably, the container includes a neck having an open passageway therethrough for passage of liquid to/from the chamber. Most preferably, the open passageway is centrally located with respect to the footprint of the body.

In preferred embodiments, the intersection between the neck and the body is a closed loop which has a non-planar profile. Most preferably, the body, neck and open passageway have a common axis extending upwards through the container, and the closed loop is concentric with said common axis. The closed loop preferably has a circular footprint.

The base of the neck preferably has a substantially cylindrical part concentric with said common axis, with the closed loop curving around said common axis at a constant radius and in a direction parallel to said common axis.

The body preferably defines shoulders and the closed loop is located at the transition between the substantially cylindrical part and the shoulders of the body.

The cylindrical part preferably defines a circular footprint.

The side walls of the cylindrical part are preferably parallel with the common axis.

There is also provided a method of making a plastics container comprising the steps of providing a mould configured for producing a container according to either of the above aspects of the invention; and blow moulding plastics in the mould, i.e. to produce a container according to the respective aspect of the invention.

There is also provided a method for producing a lightweight plastics container, the method involving the step of blow moulding plastics in a mould tool having a cavity configured to produce a container according to either of the above aspects of the invention, wherein the mould tool has a split line and the cavity is configured so that the longitudinal axis of the footprint is aligned with the split line of the mould tool, so that the extent of parison stretch away from the mould tool part line is less than the extent of parison stretch along the part line.

There is also provided a method for reducing the weight of plastics in blow moulded plastics container suitable to pass a 60 N top load test, the method involving the step of blow moulding plastics in a mould tool having a cavity configured to produce a container according to either of the above aspects of the invention, wherein the mould tool has a split line and the cavity is configured so that the longitudinal axis of the footprint is aligned with the split line of the mould tool, so that the extent of parison stretch away from the mould tool part line is less than the extent of parison stretch along the part line.

According to another aspect of the invention, there is provided a method of producing a plastics container, the method comprising the step of providing a mould tool configured to produce a container of the kind having a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein the maximum radial extent of the footprint from the centre point is greatest where the footprint intersects the longitudinal axis, corresponding to the location of two of said corner regions, the method further comprising the step of blow moulding plastics in said mould tool.

Preferably, the mould tool has a split line arranged corner to corner with respect to the desired footprint of the blow moulded container, wherein the longitudinal axis of the footprint is aligned with the split line of the mould tool, so that the extent of parison stretch away from the mould tool part line is less than the extent of parison stretch along the part line.

According to another aspect of the invention, there is provided a method of producing a plastics container, the method comprising the step of providing a mould tool configured to produce a container of the kind having a body with a footprint having a transverse axis extending in a first direction and a longitudinal axis extending in a second direction which is perpendicular to said first direction, wherein the footprint defines four major sides and four major corner regions, with each corner region arranged between a respective two of said major sides, and the footprint has a centre point through which the longitudinal and transverse axes extend, wherein the maximum radial extent of the footprint from the centre point is greatest where the footprint intersects the longitudinal axis, corresponding to the location of two of said corner regions.

Preferably, the mould tool has a split line arranged corner to corner with respect to the desired footprint of the blow moulded container, wherein the longitudinal axis of the footprint is aligned with the split line of the mould tool, so that the extent of parison stretch away from the mould tool part line is less than the extent of parison stretch along the part line.

According to another aspect of the invention there is provided a blow moulded plastics container for storing liquid (e.g. milk), the container having a body with a central axis intended to be generally vertical during storage and a pouring aperture which is concentric with said central axis, wherein the body has a footprint with a transverse axis extending in a first direction and a longitudinal axis extending in a second direction which is perpendicular to said first direction, and the point of intersection of the central axis, transverse axis and longitudinal axis defines a centre point of the footprint, the footprint having four major sides and four major corner regions, with each corner region arranged between a respective two of said major sides, wherein the maximum radial extent of the footprint from the centre point is greatest where the footprint intersects the longitudinal axis, corresponding to the location of two of said corner regions, and the radial extent from the centre point at the other two of said four corner regions is less than the maximum radial extent of the footprint.

Preferably, a first two of said major corner regions are arranged at least generally in opposition along the longitudinal axis and a second two of said major corner regions are asymmetrically arranged about said longitudinal axis.

Preferably, the transverse axis is arranged halfway along the longitudinal axis, and the second two of said corner regions are off set from said transverse axis.

According to another aspect of the invention, there is provided a blow moulded plastics container for storing liquid (e.g. milk), wherein the container is of the kind having a body with a central axis intended to be generally vertical during storage, and an integral handle intended to be generally upright during storage and defining a handle eye with an aperture axis extending in a first direction through the body, and said aperture is taller than it is wide, wherein the body has a footprint with a longitudinal axis extending in a second direction which is perpendicular to said first direction, wherein the footprint defines four major sides and four major corner regions, with each major corner region arranged between a respective two of said major sides, wherein the footprint has a centre point through which the longitudinal axis of the footprint extends and which is concentric with the central axis of the body, wherein the maximum radial extent of the footprint from the centre point is greatest where the footprint intersects the longitudinal axis, corresponding to the location of two of said major corner regions, and the radial extent from the centre point at the other two of said four corner regions is less than the maximum radial extent of the footprint, wherein a first two of said major corner regions are arranged at least generally in opposition along the longitudinal axis, and wherein a second two of said major corner regions are asymmetrically arranged about said longitudinal axis, and wherein the body defines a relief region on either side of the handle eye, and the size of the relief region on one side of the longitudinal axis is greater than the size of the relief region on the other side of the longitudinal axis.

Other aspects and features of the invention will be apparent from the claims and the following description of preferred embodiments, made by way of example with reference to the accompanying drawings, in which:

Figure 1:
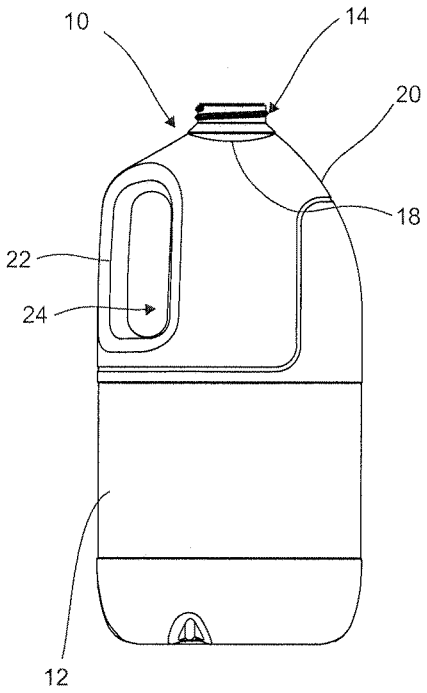
FIG. 1 is a schematic view from the side of first embodiment of a plastics container.
Figure 2:
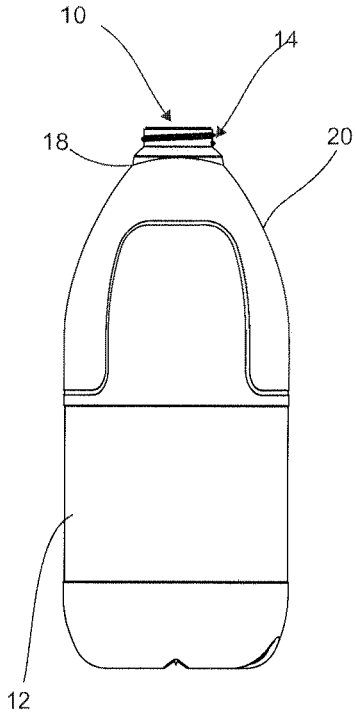
FIG. 2 is a schematic view from the front of the plastics container of FIG. 1.
Figure 3:
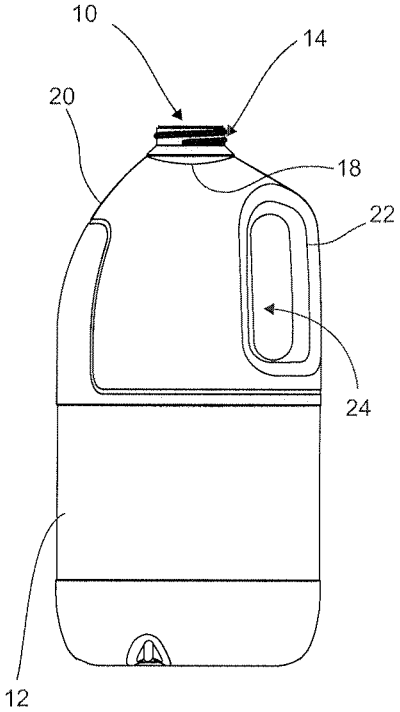
FIG. 3 is a schematic view from the other side of the plastics container of FIG. 1.
Figure 4:
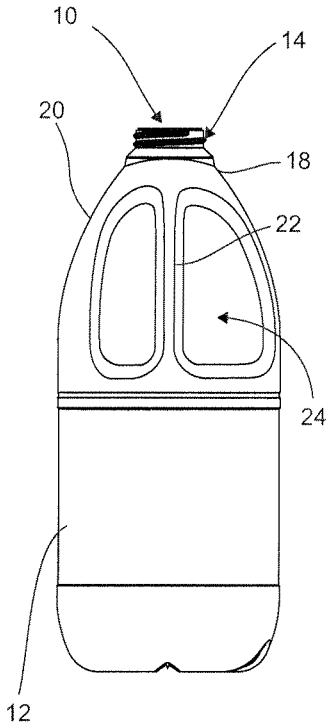
FIG. 4 is a schematic view from the rear of the plastics container of FIG. 1.

Referring firstly to FIGS. 1 to 6, there is shown a lightweight blow moulded plastics container 10. The container 10 comprises a body portion 12 and a neck portion 14. The body portion 12 defines an internal chamber for storing liquid (e.g. milk). The neck portion 14 is mounted on and extends from the body portion 12 and has an open passageway 16 therethrough which communicates with the chamber and through which the container 10 is filled with, and emptied of, liquid. As is normal in the art, the passageway 16 may by covered with a hermetic seal.

The neck portion 14 intersects the body portion 12 in a closed loop with a non-planar profile. The closed loop is located at the transition between a substantially cylindrical wall 18 at the base of the neck portion 14 and the upper part or shoulders 20 of the body portion 12.

Figure 26:
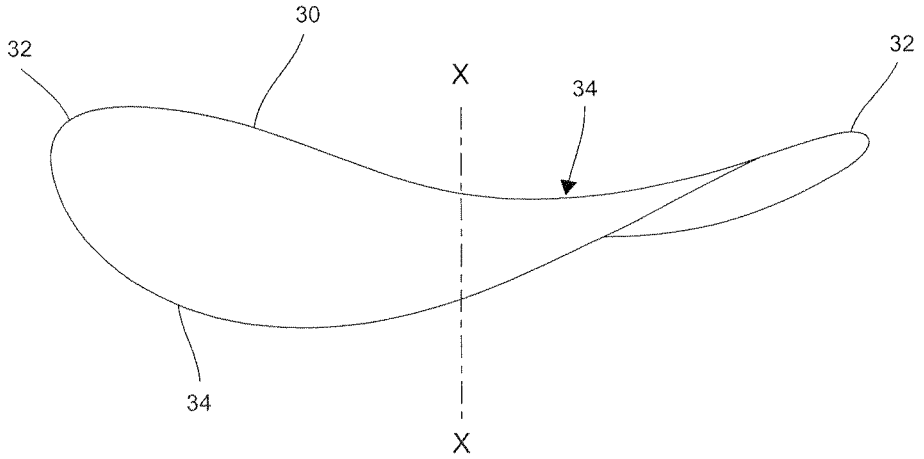
FIG. 26 illustrates a standard saddle surface for a liquid container.

The non-planar profile of the closed loop is best discussed with reference to FIG. 26 (which shows a standard saddle surface 30 for a container) and FIGS. 27 and 28 (which show a close up of a preferred neck/body intersection for the container 10). The closed loop lies on such a surface at a fixed distance from the central axis XX.

Figure 27:
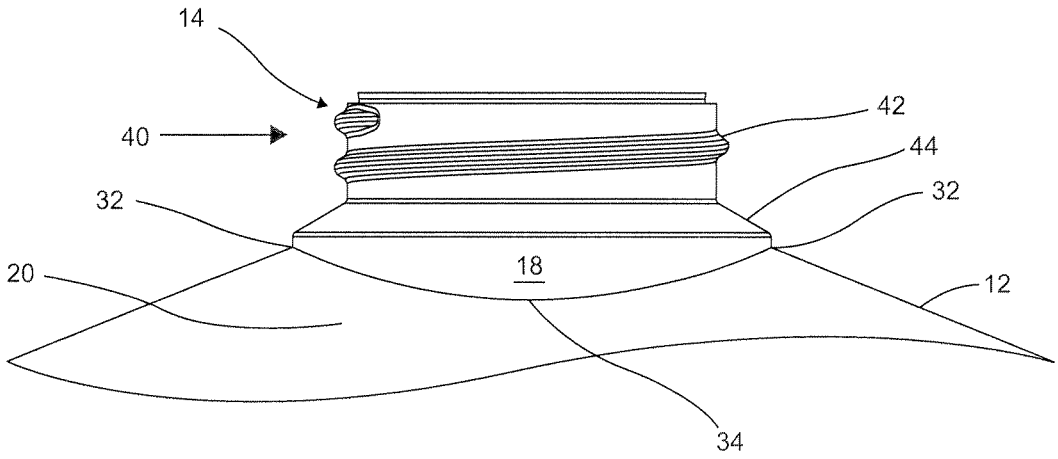
FIG. 27 shows a close up of a preferred neck for a container in accordance with the invention.
Figure 28:
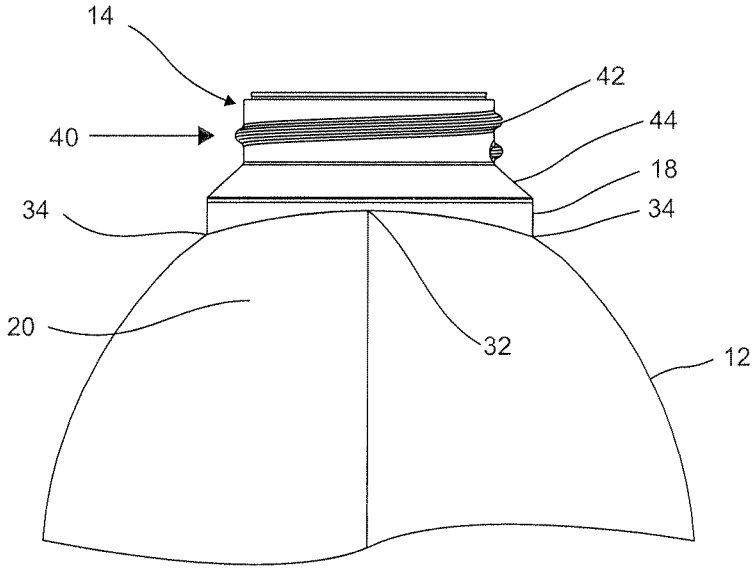
FIG. 28 is a view of the close up of FIG. 28 turned through ninety degrees.

The closed loop has a pair of maxima 32 and a pair of minima 34, and these are seen in FIGS. 27 and 28 disposed equidistantly around the circumference of the cylindrical wall 18.

In the illustrated embodiment, the closed loop has a substantially circular footprint, being bound by cylindrical wall 18.

The neck portion 14 may have a substantially cylindrical upper part 40 with a screw thread 42 for engaging a lid (not shown) with a corresponding screw thread. The cylindrical upper part 40 and cylindrical wall 18 at the base of the neck portion 14 are separated by a frusto-conical section 44, arranged such that the neck portion is wider at its base than at its free end. The cylindrical upper part 40, cylindrical wall 18 and frusto-conical section 44 are all centred on a common longitudinal axis. The height of the cylindrical wall 18 (in a direction parallel to the common longitudinal axis) varies in a circumferential direction around the periphery of the neck portion 14, dependent upon curvature of the closed loop in a direction parallel to the common longitudinal axis. The lower end of the cylindrical wall 18 defines the non-planar intersection with the shoulder region of the body portion 12.

It should be noted that the container 10 is of the kind configured to stand on a planar surface, e.g. on a trolley or refrigerator shelf. More particularly, the body portion 12, neck portion 14 and open passageway 16 have a common (central) axis, intended to be generally vertical during storage of the container (i.e. with the rim of the open passageway 16 presented generally horizontally). The closed loop is coaxial with said common longitudinal axis of the body portion 12, neck portion 14 and open passageway 16. The concentricity of the body portion 12, neck portion 14, open passageway 16 and closed loop is desirable to avoid twisting forces that might otherwise occur during topload force testing.

The container may also be referred to as a "centre neck" container, by virtue of the open passageway being concentric with the central longitudinal axis of the body portion of the container. Such a configuration is particularly advantageous in reducing foaming effects during the filling of the container with liquid, e.g. milk.

Figure 29:
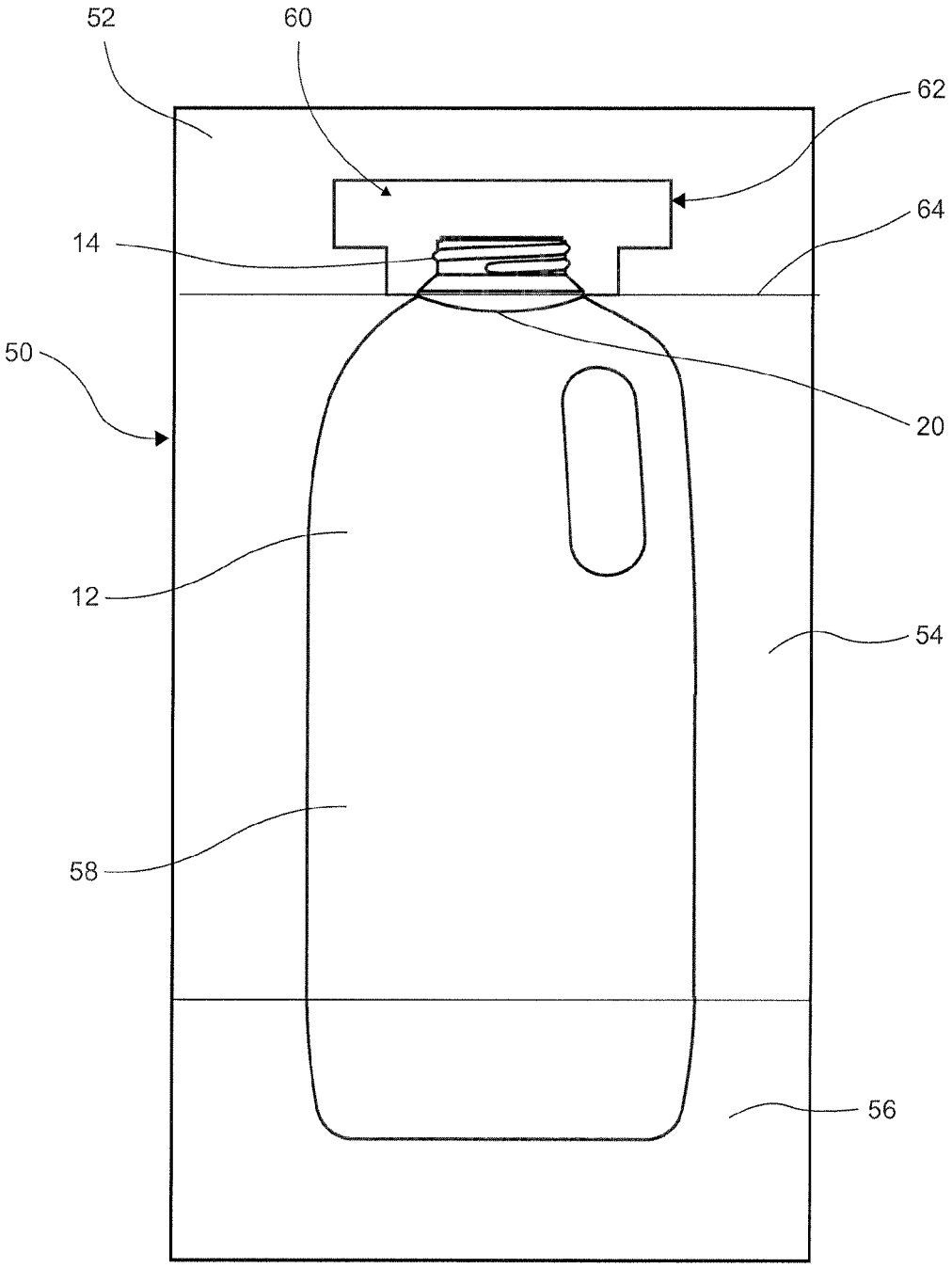
FIG. 29 is a schematic cross section through mould tool for blow moulding the neck/body intersection of FIGS. 28 and 29.

The container 10 is manufactured by blow moulding using an appropriately shaped mould tool. An example of a suitable tool is shown in FIG. 29, wherein the tool 50 includes a neck block 52, body block 54 and base block 56. The body block 54 and base block 56 define a continuous cavity 58 in which the body portion 12 of the container 10 is formed. The neck block 52 defines a cavity 60 in which the threaded neck portion 14 of the container 10 is formed.

As is common in the art, the neck block 52 is provided with a neck insert 62 configured to define the desired shape and thread formation of the neck portion 14. Neck inserts of different internal configuration are interchangeable within the neck block 52. Similarly, the neck block 52 may be interchangeable with different body blocks 54.

It will be understood that the body portion 12 and neck portion 14 are distinct parts of the container 10, which are conventionally defined by distinct pieces of the mould tool 50, i.e. the body block 54 and neck block 52, respectively, separated by a split line 64 of the tool 50 (at the transition between the neck block 52 and the body block 54). However, in preferred embodiments of the invention, the closed loop is below the split line. More particularly, the cylindrical part 18 of the neck portion 14 is formed below the split line 64, within the body block 54. Hence, the closed loop is located adjacent, yet below, what is commonly referred to as the 'neck platform' of the container (known conventionally as the part of the neck portion which meets the shoulders of the body portion). However, in this case, the cylindrical part is effectively an intermediate formation between the neck platform and the shoulders of the body portion. In each case, it will be preferred if the closed loop and associated intermediate formation is formed in the body block 54, so that different threaded portions can be blow moulded therewith using different neck blocks 52.

The result is a strengthened container, which overcomes the conventional requirement for increased wall thickness between the neck and body portions in order to overcome structural weakness.

Referring back to FIG. 1, it can be seen that the body portion 12 is formed with an integral handle 22 which defines an aperture 24 (often referred to as the 'handle eye'). The handle 22 is intended to be generally upright during storage. In this embodiment, the handle eye is taller than it is wide.

Figure 5:
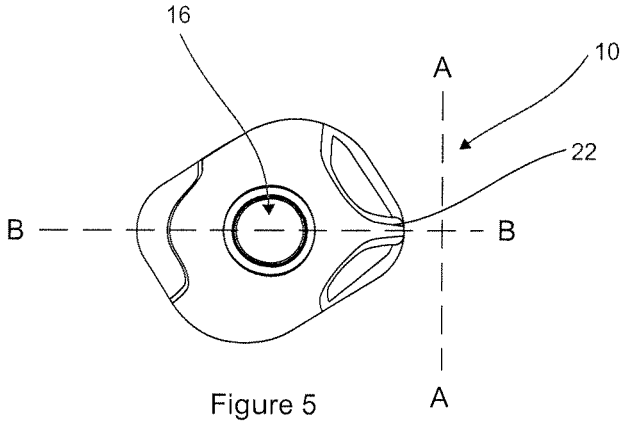
FIG. 5 is a schematic plan view from above of the container of FIG. 1.

As shown in FIG. 5, the aperture 24 has an aperture axis AA extending in a first direction through the body portion 12. The body portion 12 has a footprint with a longitudinal axis BB (shown also in FIG. 6) extending in a second direction which is perpendicular to said first direction.

Figure 6:
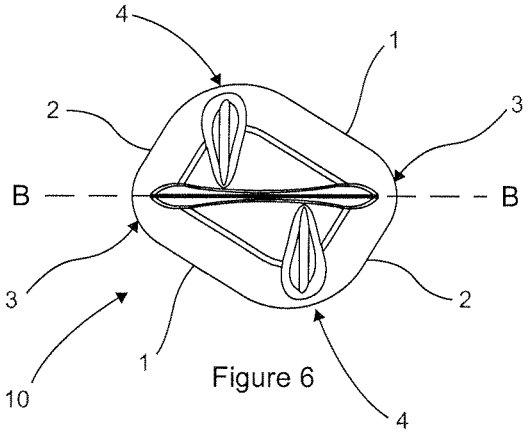
FIG. 6 is a schematic plan view from below the container of FIG. 1.
Figure 7:
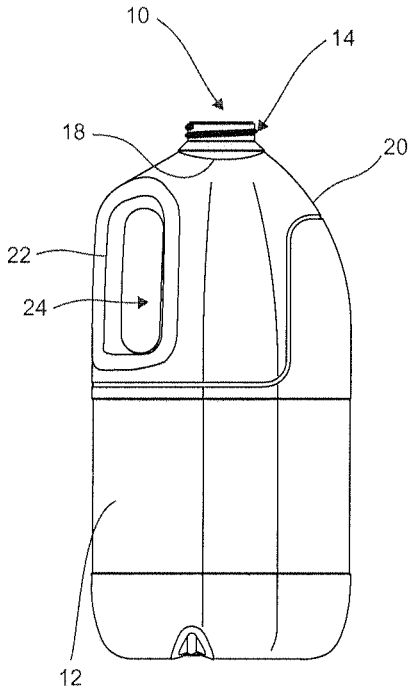
FIG. 7 is a schematic view from the side of first embodiment of a plastics container.
Figure 8:
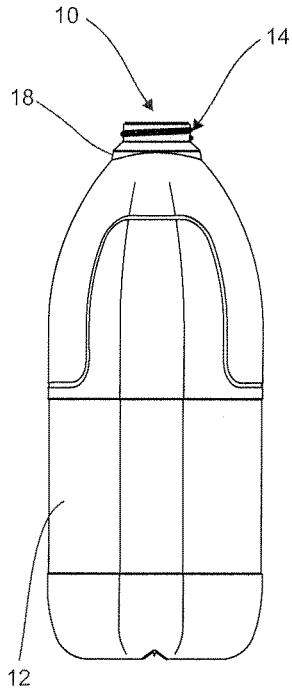
FIG. 8 is a schematic view from the front of the plastics container of FIG. 7.
Figure 9:
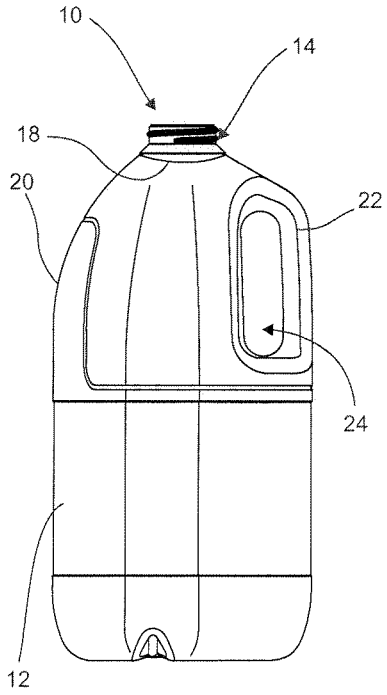
FIG. 9 is a schematic view from the other side of the plastics container of FIG. 7.
Figure 10:
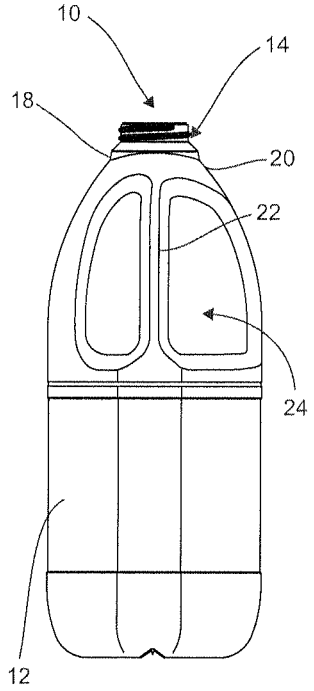
FIG. 10 is a schematic view from the rear of the plastics container of FIG. 7.
Figure 11:
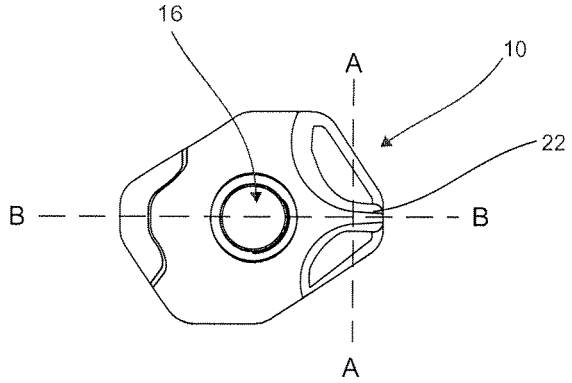
FIG. 11 is a schematic plan view from above of the container of FIG. 7.
Figure 12:
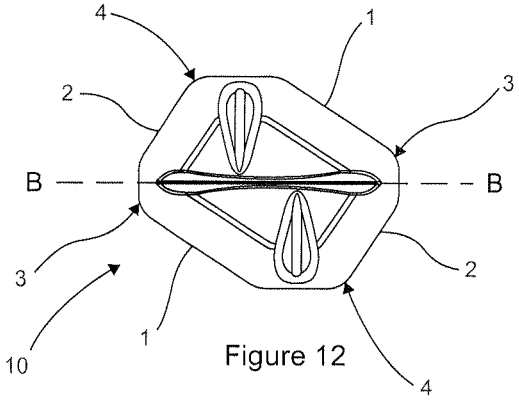
FIG. 12 is a schematic plan view from below the container of FIG. 7.
Figure 13:
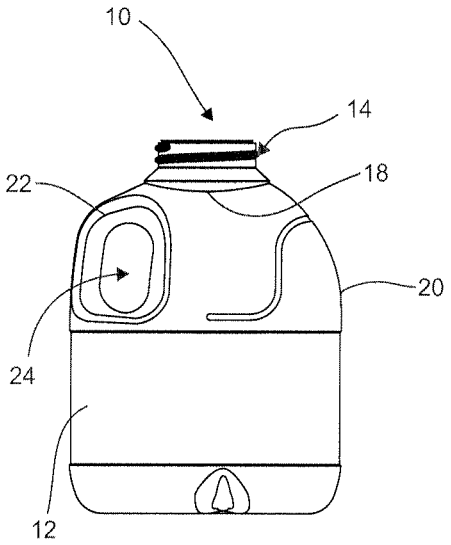
FIG. 13 is a schematic view from the side of first embodiment of a plastics container.
Figure 14:
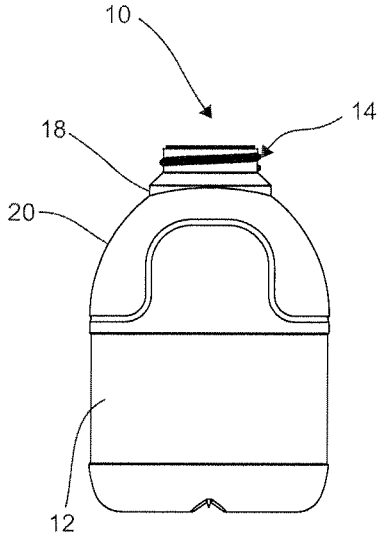
FIG. 14 is a schematic view from the front of the plastics container of FIG. 13.
Figure 15:
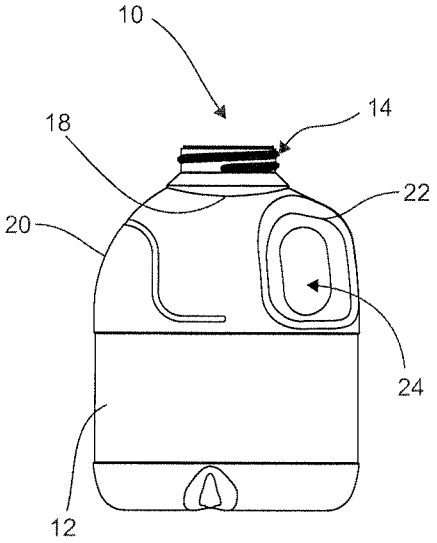
FIG. 15 is a schematic view from the other side of the plastics container of FIG. 13.
Figure 16:
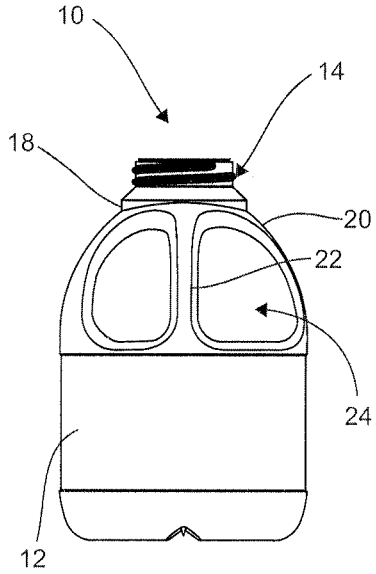
FIG. 16 is a schematic view from the rear of the plastics container of FIG. 13.
Figure 17:
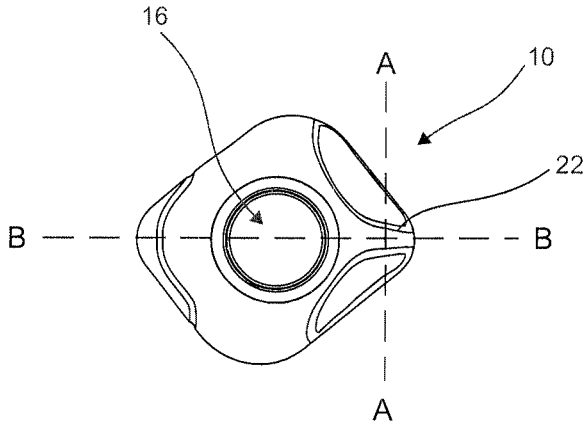
FIG. 17 is a schematic plan view from above of the container of FIG. 13.
Figure 18:
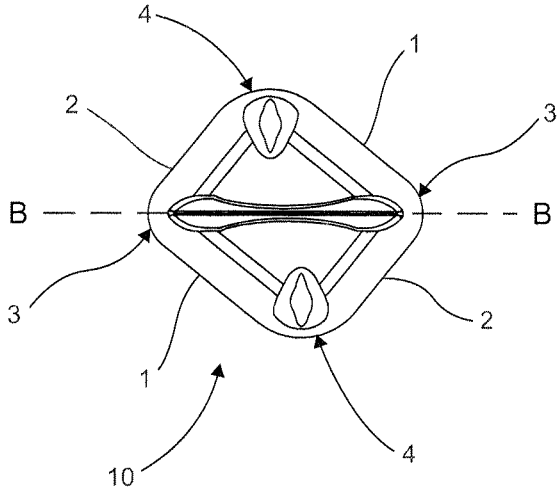
FIG. 18 is a schematic plan view from below the container of FIG. 13.
Figure 19:
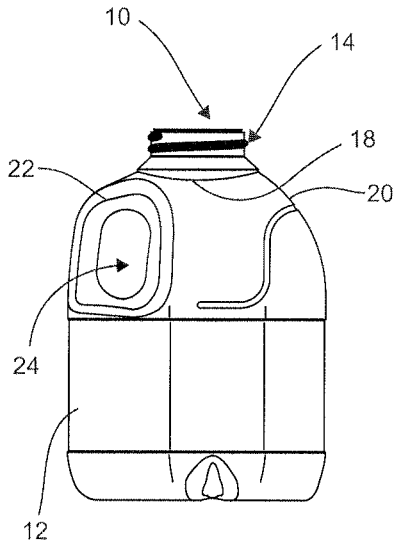
FIG. 19 is a schematic view from the side of first embodiment of a plastics container.
Figure 20:
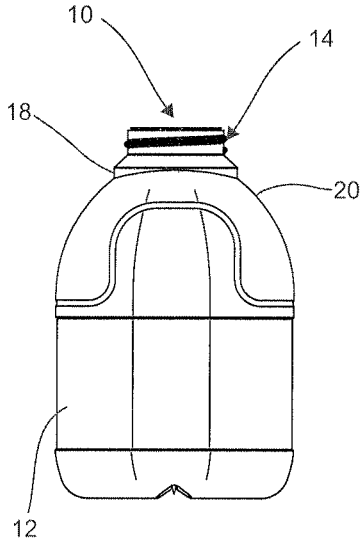
FIG. 20 is a schematic view from the front of the plastics container of FIG. 19.
Figure 21:
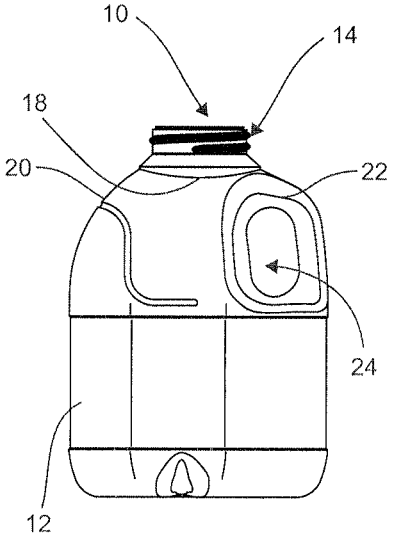
FIG. 21 is a schematic view from the other side of the plastics container of FIG. 19.
Figure 22:
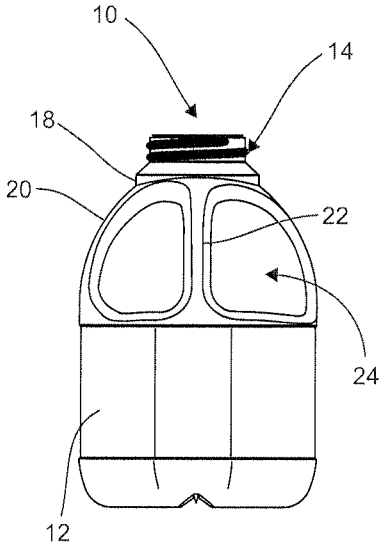
FIG. 22 is a schematic view from the rear of the plastics container of FIG. 19.
Figure 23:
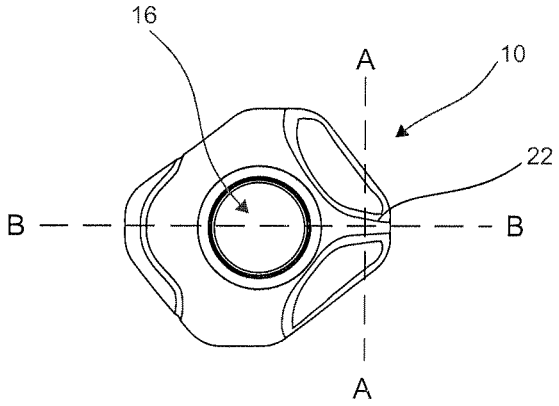
FIG. 23 is a schematic plan view from above of the container of FIG. 19.
Figure 24:
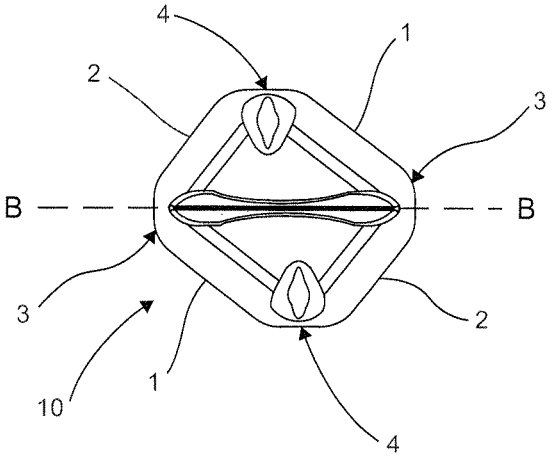
FIG. 24 is a schematic plan view from below the container of FIG. 19.

As can be seen best in FIG. 6, the footprint is generally rectangular, defining four major sides 1, 2 and four major corner regions 3, 4, with each corner region 3, 4 arranged between a respective two of said major sides 1, 2, and with the corner regions 3 arranged at least generally in opposition along the longitudinal axis BB.

This configuration results in a footprint (e.g. when viewed from above or below) having a centre point, wherein the maximum radial extent of the footprint from the centre point is greatest along the longitudinal axis BB (i.e. at the corner regions 3) and wherein the radial extent at the other two corner regions 4 is less than the maximum radial extent of the footprint.

This configuration has been found to be advantageous for a blow moulded product, particularly with respect to reducing wall thinning effects associated with the conventional blow moulding of square or rectangular containers.

It should be noted that a known plastics container has a substantially rectangular footprint, with two corner regions on each side of a notional centre line aligned with the longitudinal axis, with all four corner regions equidistant from the centre point of the footprint. An example of such a known footprint is shown at 300 in FIG. 25. Such a container may be of blow moulded construction, e.g. formed by blow moulding a parison 310 in a mould with two parts 320, 330 which separate along a notional centre line 340 (e.g. along the central longitudinal axis of the footprint of the container in FIG. 25) when ejecting the container from the mould.

Figure 25:
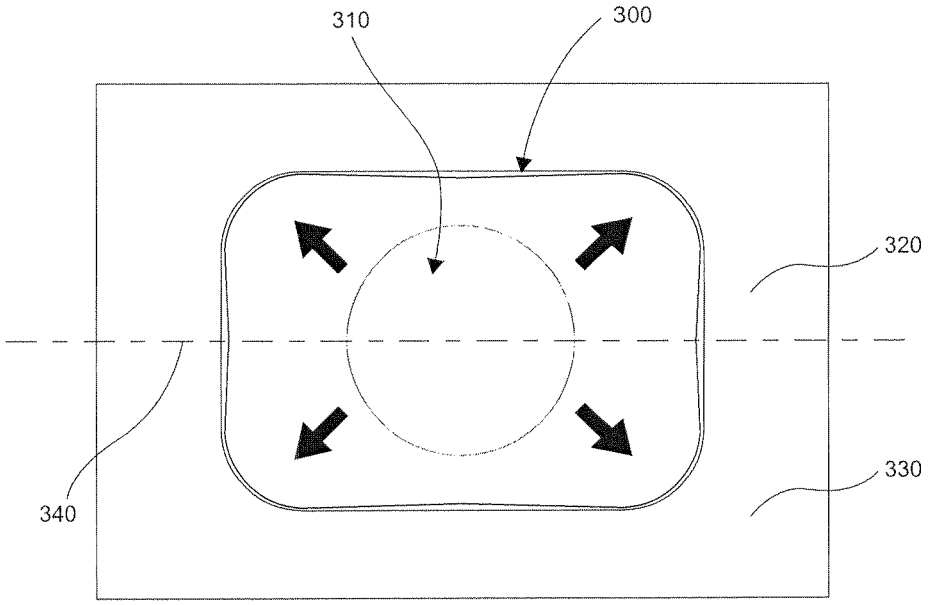
FIG. 25 is a schematic diagram showing a cross-section through a mould tool for blow moulding a plastics container of substantially rectangular footprint with a split line through opposing parallel surfaces of the footprint.

However, by modifying the tool so that the split line 340 of the mould tool parts 320, 330 is arranged generally 'corner to corner' of the desired footprint, i.e. along the longitudinal axis BB (effectively at 45 degrees to that shown in FIG. 25) and limiting the radial extent of the footprint away from the split line, it has been found that stretching/thinning effects on the parison 310 are likely to be less extreme than with conventional mould tools of the kind shown in FIG. 25, resulting in more even distribution of plastic within the wall thickness. Tests have shown that the overall weight of the plastics container may be reduced by adopting this footprint, whilst maintaining storage capacity and the structural integrity necessary to meet the 60 N top load force test requirement.

It should be noted that the longitudinal axis BB of the footprint of the container in FIGS. 1 to 6 is aligned with the split line of the mould tool in which it was blow moulded. The handle eye 24 of the container is also aligned with said split line. However, embodiments without handles are also envisaged.

The footprint of the container 10 has a transverse axis perpendicular to the longitudinal axis BB, the transverse axis being located halfway along the longitudinal axis BB, i.e. through the centre point of the footprint (which lies on the common axis of the neck portion described above), wherein the corner regions 4 are asymmetrically arranged about said longitudinal axis BB and are off set from said transverse axis. The aperture axis AA of the handle eye 24 is parallel with the transverse axis of the footprint.

FIGS. 7 to 24 relate to three other embodiments of containers having the same generally rectangular and 'corner to corner' axis configuration as the embodiment of FIGS. 1 to 6. They include the same reference numerals for corresponding parts.

These embodiments relate to containers of different capacity, but are otherwise not described here in significant detail. Rather, it should be noted that in each of the embodiments of FIGS. 1 to 24, the footprint is of generally rectangular (not square) configuration, including four major sides consisting of two pairs of parallel sides, with the first of said two pairs arranged perpendicular to the second of said two pairs, and with the sides in said first pair being longer than the sides in said second pair. The corner regions 3, 4 may be rounded (e.g. as in FIG. 5) or truncated (e.g. as in FIG. 11), thereby producing a footprint with up to four additional sides (e.g. at one or more of the corner regions), whilst still maintaining a generally rectangular footprint, suitable for uniform alignment on a filling line or storage trolley, for example. A combination of truncated and/or rounded and/or sharp corner regions may be preferred. However, the degree of curvature or truncation at the corner regions away from the longitudinal axis will preferably differs from the degree of curvature or truncation at the corner regions along the longitudinal axis, e.g. so as to be more curved/rounded (than angular) or truncated away from longitudinal axis, as shown in the illustrated embodiments.

In each of the embodiments of FIGS. 1 to 24, the footprint has a centre point, wherein the maximum radial extent of the footprint from the centre point is greatest at the point at which the corner regions intersect the longitudinal axis BB (i.e. at the corner regions 3) and wherein the radial extent at the other two corner regions 4 is less than the maximum radial extent of the footprint. Indeed, at no point away from the axis BB is the radial extent of the footprint greater than or equal to the radial extent on the axis BB at the corner regions 3.

For each of the embodiments of FIGS. 1 to 24, the footprint of the body, when viewed from beneath, is rotationally symmetrical about said longitudinal axis BB.

The integral handle 22 is arranged at a corner 3 of the container and extends in line with the longitudinal axis BB of the footprint. The integral handle is also arranged to extend in a direction which is substantially 45 degrees to the four major sides 1, 2 of the footprint.

Each of the embodiments includes the non-planar neck intersection described with reference to FIGS. 26 to 28. However, a planar neck intersection may be preferred, e.g. if the necessary topload force test requirement can be fulfilled.

As can be seen most clearly from the rear and plan views of the embodiments of FIGS. 1 to 24, the body portion 14 defines a relief region on either side of the handle aperture 24 into or through which the user's fingers will extend when picking up the container 10 using the handle 22. However, the geometry of the containers in accordance with the preferred embodiments of the invention illustrated in FIGS. 1 to 24 means that the size of the relief region on one side of the longitudinal axis BB is greater than the size of the relief region on the other side of the longitudinal axis BB. This has been found to provide a physical advantage when holding the container by the handle or when the container is presented for pick up by a user, e.g. from cold storage in a conventional domestic refrigerator (depending on the direction of opening of the refrigerator door or the natural dexterity of the user).

The containers described herein are preferably formed by blow moulding. Preferably, the mould tool is configured such that the longitudinal axis of the handle and longitudinal axis of the body are in line with one another along a centre split line of the tool (such that the handle is arranged at one corner of the body). Put another way, the mould tool is configured so that the mould split line is arranged corner to corner with respect to the body of the container to be produced, with the middle region of the body extending in the direction of opening of the tool (perpendicular to the split line) by a more limited extent than along the split line. The configuration of the preferred embodiments, wherein the maximum radial extent of the footprint from the centre point is greatest at the point at which the corner regions intersect the longitudinal axis (and the radial extent at the other two corner regions is less than the maximum radial extent of the footprint) ensures that the extent of parison stretch away from the mould tool part line is less than the extent of parison stretch along the part line.

The invention claimed is:

1. A blow moulded plastics container for storing liquid, wherein the container comprises a body with a central axis intended to be generally vertical during storage, an integral handle intended to be generally upright during storage and defining a handle eye with an aperture axis extending in a first direction through the body, said handle eye being taller than it is wide, and said body has a footprint with a longitudinal axis extending in a second direction which is perpendicular to said first direction, wherein the footprint defines four major sides and four major corner regions, with each major corner region arranged between a respective two of said major sides, the footprint has a centre point through which the longitudinal axis of the footprint extends and which is concentric with the central axis of the body, and wherein a maximum radial extent of the footprint from the centre point is greatest where the footprint intersects the longitudinal axis, corresponding to the location of two of said major corner regions, and the radial extent from the centre point at the other two of said four corner regions is less than the maximum radial extent of the footprint, a first two of said major corner regions are arranged at least generally in opposition along the longitudinal axis and a second two of said major corner regions are asymmetrically arranged about said longitudinal axis, and wherein the body defines a relief region on either side of the handle eye, and the size of the relief region on one side of the longitudinal axis is greater than the size of the relief region on the other side of the longitudinal axis.

2. A container according to claim 1 wherein the footprint is of generally rectangular configuration, with the four major sides comprising two pairs of generally parallel sides, with the first of said two pairs arranged perpendicular to the second of said two pairs, and the sides in said first pair being longer than the sides in said second pair.

3. A container according to claim 1 wherein the footprint has a transverse axis perpendicular to the longitudinal axis and arranged halfway along the longitudinal axis, and the second two of said corner regions are off set from said transverse axis.

4. A container according to claim 1 wherein the footprint, when viewed from beneath, is rotationally symmetrical about said longitudinal axis.

5. A container according to claim 1 wherein any of said corner regions may be rounded or truncated, rather than defining a sharp rectangular corner region.

6. A container according to claim 5 wherein the degree of curvature or truncation at the corner regions away from the longitudinal axis is differs from the degree of curvature or truncation at the corner regions along the longitudinal axis, so as to be more curved/rounded or truncated away from longitudinal axis.

7. A container according to claim 1 wherein the body defines a chamber for storing said liquid, with the chamber extending into and/or through the integral handle, and wherein the container includes a neck having an open passageway therethrough for passage of said liquid to/from the chamber.

8. A container according to claim 7 wherein the open passageway is centrally located with respect to the footprint of the body.

9. A container according to claim 7, wherein the intersection between the neck and the body is a closed loop which has a non-planar profile.

10. A container according to claim 9 wherein the body, neck and open passageway have a common axis extending upwards through the container, and the closed loop is concentric with said common axis.

11. A method of producing a plastics container for storing liquid, the method comprising:

providing a mould tool configured so that blow moulding plastics in the mould tool results in a container including a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein a maximum radial extent of the footprint from the centre point is greatest where the footprint intersects the longitudinal axis, corresponding to the location of two of said corner regions, and the radial extent from the centre point at the other two of said four corner regions is less than the maximum radial extent of the footprint, a first two of said major corner regions are arranged at least generally in opposition along the longitudinal axis and a second two of said major corner regions are asymmetrically arranged about said longitudinal axis, and wherein the body defines a relief region on either side of the handle eye, and the size of the relief region on one side of the longitudinal axis is greater than the size of the relief region on the other side of the longitudinal axis; and blow moulding plastics in said mould tool.

12. A method of producing a plastics container for storing liquid, wherein the container comprises a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein a maximum radial extent of the footprint from the centre point is greatest where the footprint intersects the longitudinal axis, corresponding to the location of two of said corner regions, the method comprising blow moulding plastics in a mould tool including a split line, so that the extent of parison stretch away from the mould tool split line is less than the extent of parison stretch along the split line.

13. A mould tool configured for producing a blow moulded plastics container for storing liquid, the mould tool being configured for making the container comprising a body with a central axis intended to be generally vertical during storage, an integral handle intended to be generally upright during storage and defining a handle eye with an aperture axis extending in a first direction through the body, said handle eye being taller than it is wide, and said body has a footprint with a longitudinal axis extending in a second direction which is perpendicular to said first direction, wherein the mould tool is configured such that the footprint of the container defines four major sides and four major corner regions, with each major corner region arranged between a respective two of said major sides, and such that the footprint has a centre point through which the longitudinal axis of the footprint extends and which is concentric with the central axis of the body, and the mould tool is further configured such that a maximum radial extent of the footprint from the centre point is greatest where the footprint intersects the longitudinal axis, corresponding to the location of two of said major corner regions, and the radial extent from the centre point at the other two of said four corner regions is less than the maximum radial extent of the footprint, a first two of said major corner regions are arranged at least generally in opposition along the longitudinal axis and a second two of said major corner regions are asymmetrically arranged about said longitudinal axis, and the mould tool is configured such that the body defines a relief region on either side of the handle eye, and the size of the relief region on one side of the longitudinal axis is greater than the size of the relief region on the other side of the longitudinal axis.

14. A blow moulded plastics container for storing liquid, the container having a body with a central axis intended to be generally vertical during storage wherein the body has a footprint with a transverse axis extending in a first direction and a longitudinal axis extending in a second direction which is perpendicular to said first direction, and the point of intersection of the central axis, transverse axis and longitudinal axis defines a centre point of the footprint, the footprint having four major sides and four major corner regions, with each corner region arranged between a respective two of said major sides, wherein a maximum radial extent of the footprint from the centre point is greatest where the footprint intersects the longitudinal axis, corresponding to the location of two of said corner regions, and the radial extent from the centre point at the other two of said four corner regions is less than the maximum radial extent of the footprint, and wherein a first two of said major corner regions are arranged at least generally in opposition along the longitudinal axis and a second two of said major corner regions are asymmetrically arranged about said longitudinal axis.

15. A container according to claim 14 the footprint is rotationally symmetrical about said longitudinal axis.

16. A container according to claim 14 wherein at no point away from the longitudinal axis is the radial extent of the footprint greater than or equal to the radial extent on the longitudinal axis.

17. A container according to claim 14 wherein the footprint is of generally rectangular configuration, with the four major sides comprising two pairs of parallel sides, with the first of said two pairs arranged perpendicular to the second of said two pairs, and the sides in said first pair longer than the sides in said second pair.

18. A container according to claim 14 wherein the body has an integral handle intended to be generally upright during storage and defining a handle eye which is preferably taller than it is wide.

19. A container according to claim 18 wherein the integral handle is arranged at a corner of the container and extends in line with said longitudinal axis of the footprint.

20. A container according to claim 19 wherein the body defines a relief region on either side of the handle eye, wherein size of the relief region on one side of the longitudinal axis is greater than the size of the relief region on the other side of the longitudinal axis.

21. A container according to claim 1 wherein the body has a pouring aperture which is part of a neck on the body, and the intersection between the neck and the body is a closed loop which has a non-planar profile concentric with said central axis.

22. A method of producing a plastics container for storing liquid, the method comprising:

providing a mould tool configured so that blow moulding plastics in the mould tool results in a container having a body with a central axis intended to be generally vertical during storage wherein the body has a footprint with a transverse axis extending in a first direction and a longitudinal axis extending in a second direction which is perpendicular to said first direction, and the point of intersection of the central axis, transverse axis and longitudinal axis defines a centre point of the footprint, the footprint having four major sides and four major corner regions, with each corner region arranged between a respective two of said major sides, wherein a maximum radial extent of the footprint from the centre point is greatest where the footprint intersects the longitudinal axis, corresponding to the location of two of said corner regions, and the radial extent from the centre point at the other two of said four corner regions is less than the maximum radial extent of the footprint, and wherein a first two of said major corner regions are arranged at least generally in opposition along the longitudinal axis and a second two of said major corner regions are asymmetrically arranged about said longitudinal axis; and blow moulding plastics in said mould tool.

23. A method according to claim 22 wherein the mould tool has a split line arranged corner to corner with respect to the desired footprint of the blow moulded container, wherein the longitudinal axis of the footprint is aligned with the split line of the mould tool.

24. A method for producing a lightweight plastics container, the method comprising blow moulding plastics in a mould tool having a cavity configured to produce a container having a body with a central axis intended to be generally vertical during storage wherein the body has a footprint with a transverse axis extending in a first direction and a longitudinal axis extending in a second direction which is perpendicular to said first direction, and the point of intersection of the central axis, transverse axis and longitudinal axis defines a centre point of the footprint, the footprint having four major sides and four major corner regions, with each corner region arranged between a respective two of said major sides, wherein a maximum radial extent of the footprint from the centre point is greatest where the footprint intersects the longitudinal axis, corresponding to the location of two of said corner regions, and the radial extent from the centre point at the other two of said four corner regions is less than the maximum radial extent of the footprint, and wherein a first two of said major corner regions are arranged at least generally in opposition along the longitudinal axis and a second two of said major corner regions are asymmetrically arranged about said longitudinal axis, wherein the mould tool has a split line and the cavity is configured so that the longitudinal axis of the footprint is aligned with the split line of the mould tool, and the extent of parison stretch away from the mould tool split line is less than the extent of parison stretch along the split line.

25. A mould tool configured for producing a plastics container having a body with a central axis intended to be generally vertical during storage, wherein the mould tool is configured such that the body has a footprint with a transverse axis extending in a first direction and a longitudinal axis extending in a second direction which is perpendicular to said first direction, and such that the point of intersection of the central axis, transverse axis and longitudinal axis defines a centre point of the footprint, the mould tool being further configured such that the footprint has four major sides and four major corner regions, with each corner region arranged between a respective two of said major sides, and the mould tool being configured such that a maximum radial extent of the footprint from the centre point is greatest where the footprint intersects the longitudinal axis, corresponding to the location of two of said corner regions, and such that the radial extent from the centre point at the other two of said four corner regions is less than the maximum radial extent of the footprint, and wherein the mould tool is configured such that a first two of said major corner regions are arranged at least generally in opposition along the longitudinal axis and a second two of said major corner regions are asymmetrically arranged about said longitudinal axis.

26. A method of producing a plastics container, the method comprising the step of providing a mould tool configured to produce a container having a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein a maximum radial extent of the footprint from the centre point is greatest where the footprint intersects the longitudinal axis, corresponding to the location of two of said corner regions, wherein the mould tool has a split line arranged corner to corner with respect to the desired footprint of the blow moulded container, wherein the longitudinal axis of the footprint is aligned with the split line of the mould tool, the method further comprising the step of blow moulding plastics in said mould tool, so that the extent of parison stretch away from the mould tool split line is less than the extent of parison stretch along the split line.

27. A method of producing a plastics container, the method comprising the step of providing a mould tool configured to produce a container having a body with a footprint having a transverse axis extending in a first direction and a longitudinal axis extending in a second direction which is perpendicular to said first direction, wherein the footprint defines four major sides and four major corner regions, with each corner region arranged between a respective two of said major sides, and the footprint has a centre point through which the longitudinal and transverse axes extend, wherein a maximum radial extent of the footprint from the centre point is greatest where the footprint intersects the longitudinal axis, corresponding to the location of two of said corner regions, the method further comprising the step of blow moulding plastics in said mould tool, wherein the mould tool has a split line arranged corner to corner with respect to the desired footprint of the blow moulded container, wherein the longitudinal axis of the footprint is aligned with the split line of the mould tool, so that the extent of parison stretch away from the mould tool split line is less than the extent of parison stretch along the split line.

28. A plastics container made according to the method of claim 26.

29. A mould tool configured for use in producing a plastics container, the mould tool being configured to produce a container having a body with an integral handle, wherein the integral handle defines an aperture with a central axis extending in a first direction through the body, wherein the body has a footprint with a longitudinal axis extending in a second direction which is perpendicular to said first direction, wherein the footprint defines four major sides and four major corner regions, with each corner region arranged between a respective two of said major sides, the footprint has a centre point through which the longitudinal axis extends and wherein a maximum radial extent of the footprint from the centre point is greatest where the footprint intersects the longitudinal axis, corresponding to the location of two of said corner regions, wherein the mould tool has a split line arranged corner to corner with respect to the desired footprint of the blow moulded container, wherein the longitudinal axis of the footprint is aligned with the split line of the mould tool, and wherein the mould tool is configured such that when plastics are blow moulded in said mould tool, the extent of parison stretch away from the mould tool split line is less than the extent of parison stretch along the split line.

* * * * *